US007992245B2

(12) United States Patent
Schuetz et al.

(10) Patent No.: US 7,992,245 B2
(45) Date of Patent: Aug. 9, 2011

(54) CLEANING TOOL AND CLEANING DEVICE HAVING SUCH A CLEANING TOOL

(75) Inventors: Michael Schuetz, Stuttgart (DE); Juergen Walz, Moeckmuehl (DE); Wilhelm Eisenmann, Althuette (DE); Alexander Fuchs, Plauen (DE); Markus Duenne, Winnenden (DE); Ruwantha De Silva, Schwieberdingen (DE); Andreas Van De Ven, Leutenbach (DE); Rainer Schaefer, Leutenbach (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/798,453

(22) Filed: Apr. 1, 2010

(65) Prior Publication Data

US 2010/0263141 A1 Oct. 21, 2010

Related U.S. Application Data

(63) Continuation of application No. PCT/EP2008/006060, filed on Jul. 24, 2008.

(30) Foreign Application Priority Data

Oct. 11, 2007 (DE) ..... 10 2007 050 351

(51) Int. Cl.
*A47L 11/282* (2006.01)
*A47L 11/283* (2006.01)

(52) U.S. Cl. ..... 15/52.1; 15/21.1; 15/49.1; 15/82; 15/87; 116/208

(58) Field of Classification Search ..... 15/21.1, 15/49.1, 50.1, 50.3, 52.1, 82, 87, 319, 339, 15/383, 389, 391, 392; 116/208
See application file for complete search history.

(56) References Cited

U.S. PATENT DOCUMENTS

| | | | | |
|---|---|---|---|---|
| 4,679,271 | A | 7/1987 | Field et al. | |
| 5,922,968 | A | 7/1999 | Briscoe | |
| 2004/0045581 | A1 * | 3/2004 | Boomgaarden et al. | 134/6 |
| 2006/0103523 | A1 * | 5/2006 | Field | 340/540 |

FOREIGN PATENT DOCUMENTS

| | | | |
|---|---|---|---|
| DE | 33 09 967 | | 9/1984 |
| DE | 38 41 177 | | 6/1990 |
| DE | 696 08 116 | | 1/2001 |
| DE | 601 11 306 | | 3/2006 |
| EP | 0 649 626 | | 4/1995 |
| JP | 2000-217759 | * | 8/2000 |

OTHER PUBLICATIONS

*Patent Abstracts of Japan*, Abstract of Japanese Patent "Tire Wear Detecting Device and Method", Publication No. 2006151269, Jun. 15, 2006, Japanese Application No. 2004346910, Filed Nov. 30, 2004.

* cited by examiner

*Primary Examiner* — Mark Spisich
(74) *Attorney, Agent, or Firm* — Lipsitz & McAllister, LLC

(57) ABSTRACT

The invention relates to a cleaning tool for a cleaning device, the cleaning tool being subject to wear during operation. In order to make it easier to identify wear, the invention proposes that the cleaning tool comprise a sensor device with a sensor element which has a physical characteristic variable which changes as a function of the degree of wear of the cleaning tool. The invention also proposes a cleaning device having such a cleaning tool, the cleaning device having a detector device which is coupled to the sensor device for the purpose of sensing the change in the physical characteristic variable of the sensor element, and having an indicator device which is connected to the detector device.

31 Claims, 12 Drawing Sheets

180
184
183
186
182
181
185
191
189
190
193
188
194
195
192

CLEANING TOOL AND CLEANING DEVICE HAVING SUCH A CLEANING TOOL

This application is a continuation of international application number PCT/EP2008/006060 filed on Jul. 24, 2008 and claims the benefit of German Patent Application No. 10 2007 050 351.4 filed on Oct. 11, 2007.

The present disclosure relates to the subject matter disclosed in international application number PCT/EP2008/006060 of Jul. 24, 2008 and German application number 10 2007 050 351.4 of Oct. 11, 2007, which are incorporated herein by reference in their entirety and for all purposes.

BACKGROUND OF THE INVENTION

The invention relates to a cleaning tool for a cleaning device, in particular for cleaning a surface, the cleaning tool being subject to wear during operation.

The invention also relates to a cleaning device for cleaning a surface, in particular a floor surface, having at least one such cleaning tool.

Cleaning tools of surface cleaning devices, in particular floor cleaning devices, wear away during operation. When a specific degree of wear is reached, said cleaning tools have to be replaced since, otherwise, there is a risk of the surface to be cleaned being damaged and/or the achievable cleaning result being inadequate. Wearing away of the cleaning tool is usually monitored by the user, by said user inspecting the cleaning tool which is mounted on the cleaning device. However, in many cases, this is associated with difficulties since the cleaning tool is often installed in a housing of the cleaning device and therefore cannot be readily seen by the user from the outside. For example, in the case of floor cleaning devices, in particular in the case of scrubber dryers, the cleaning tool, which is in the form of a disk or roller brush, is surrounded by housing and sealing elements.

It is an object of the present invention to develop a cleaning tool and a corresponding cleaning device of the type mentioned in the introductory part such that wearing away of the cleaning tool can be identified more easily.

SUMMARY OF THE INVENTION

In the case of a cleaning tool of the generic type, this object is achieved, according to the invention, in that the cleaning tool comprises a sensor device with a sensor element which has a physical characteristic variable which changes as a function of the degree of wear of the cleaning tool.

According to the invention, the cleaning tool is equipped with a sensor device which has a sensor element which has a specific physical characteristic variable. This characteristic variable changes as a function of the degree of wear of the cleaning tool. In this case, a physical characteristic variable of the sensor element is understood to be a specific physical property, for example a mechanical, optical, thermal, magnetic or electrical property of the sensor element which changes as the cleaning tool wears away. The change in the characteristic variable can be sensed by means of a detector device and optically and/or acoustically indicated on an indicator device. The detector device can be coupled to the sensor device of the cleaning tool in a wire-bound manner or in a wireless manner, that is to say the change in the characteristic variable of the sensor element can be sensed by the detector device via a wire-bound or wireless transmission channel.

Equipping the cleaning tool with a sensor element therefore creates a simple way of identifying wearing away of the cleaning tool, without the cleaning tool having to be inspected by the user for this purpose.

It is particularly advantageous if the physical characteristic variable of the sensor element changes abruptly when a predefined degree of wear of the cleaning tool is reached. If the physical characteristic variable of the sensor element changes abruptly at a predefined level of wear of the cleaning tool, in particular the maximum permissible level of wear of the cleaning tool, this can be reliably identified by means of a detector device which is associated with the sensor device, and can be optically and/or acoustically indicated on an indicator device of the cleaning device, which indicator device is connected to the detector device. As an alternative, provision may also be made for the characteristic variable to change continuously or virtually continuously as a function of the degree of wear of the cleaning tool. This permits continuous sensing of the degree of wear, and this can be indicated on an indicator element.

As already mentioned, the physical characteristic variable of the sensor element used, which physical characteristic variable changes as a function of the degree of wear of the cleaning tool, may be, for example, an electrical characteristic variable. The physical characteristic variable is preferably the temperature, the ohmic resistance, the inductance or the capacitance of the sensor element. The sensor element can have, for example, an electrical component which can be characterized by its temperature, its ohmic resistance or by its electrical conductivity, its inductance or its capacitance. The temperature, the ohmic resistance, the inductance or the capacitance changes as a function of the degree of wear of the cleaning tool, and this change can be sensed by an associated detector device.

Provision may be made, for example, for the sensor element to comprise an electrical conductor loop, the ohmic resistance, inductance or capacitance of which changes as a function of the degree of wear of the cleaning tool. It is particularly advantageous if the electrical conductor loop can be interrupted when a predefined degree of wear of the cleaning tool is reached. Current can flow via the conductor loop as long as the conductor loop has not yet been interrupted. This flow of current is interrupted as soon as the predefined degree of wear of the cleaning tool is reached. The flow of current can be sensed by an associated detector device in a contact-free or contact-making manner. The interruption in the flow of current can be adjudged by the detector device to mean that the predefined degree of wear has been reached.

In an advantageous refinement of the invention, the sensor device has a coil to which the sensor element is connected. The coil can be shorted, for example, by means of the sensor element, that is to say the sensor element can connect the two coils ends to one another. If the ohmic resistance, the inductance or the capacitance of the sensor element changes on account of wear of the cleaning tool, the corresponding characteristic variable of the entire system comprising the coil and the sensor element therefore changes too. The coil permits inductive coupling of the sensor element to an associated detector device of the cleaning device, it being possible for the detector device to likewise comprise a coil which interacts inductively with the coil of the sensor device.

In this case, it is advantageous if the cleaning tool is rotatable about a rotation axis and the coil of the sensor device surrounds, in the circumferential direction, a preferably cylindrical portion, which is aligned coaxially with the rotation axis, of a base body of the cleaning tool. In a refinement of this type, the coil, which is integrated in the cleaning tool, rotates during operation of the cleaning tool. The detector device of the cleaning device can comprise a corresponding coil which is disposed such that it is fixed to the cleaning device. The coil of the sensor device, which coil rotates together with the base body of the cleaning tool, can then induce an electric voltage in the coil of the detector device, it being possible for the electric voltage to be evaluated by an evaluation electronics system of the detector device. If the electrical characteristic variable of the sensor element, which is connected to the coil, changes, the change in the characteristic variable influences the voltage which is induced in the coil of the detector device, and therefore the change in the characteristic variable can be sensed by the evaluation electronics system of the detector device in a simple manner, without electrically conductive coupling being required between the sensor device of the cleaning tool and the detector device of the cleaning device for this purpose.

However, it is not absolutely necessary to provide a detector device in the cleaning device. In a preferred refinement of the invention, the cleaning tool comprises a detector device which is associated with the sensor device and which can be connected to an indicator device and which detects the change in the physical characteristic variable of the sensor element. In a refinement of this type, the cleaning tool therefore has not only the sensor device but additionally also the detector device which is coupled to the sensor device. By way of example, the detector device may be in the form of an evaluation electronics system which is incorporated in the cleaning tool.

In this case, it is advantageous if the cleaning tool also comprises the indicator device and/or an energy source. The indicator device can be, in particular, in the form of an optical and/or acoustic signaling device, for example in the form of a monitoring lamp which is connected to the detector device and can be easily identified by the user. Provision may be made, in particular, for the monitoring lamp to be aligned coaxially with a rotation axis of the cleaning tool and to be disposed behind a transparent cover of the cleaning device. Illumination of the control lamp can indicate to the user that a maximum degree of wear of the cleaning tool has been reached and said cleaning tool consequently has to be replaced.

The energy source used, which energy source is incorporated in the cleaning tool, is preferably an electric battery, in particular a so-called button cell. The service life of the battery can be selected to be considerably greater than the service life of the cleaning tool, thus ensuring that the battery provides sufficient energy when a maximum degree of wear of the cleaning tool is reached, and the intention being for this to be optically and/or acoustically indicated to the user by means of the indicator device which is incorporated in the cleaning tool.

Provision may also be made for the sensor device to have electrical contact elements for connecting the sensor device to an external detector device which detects the change in the physical characteristic variable of the sensor element. The electrical contact elements used are preferably sliding contacts by means of which an electrical connection between the sensor device of the cleaning tool and the associated external detector device is ensured during operation of the cleaning tool. Therefore, provision may be made, for example, for the cleaning tool to be able to rotate about a rotation axis, said cleaning tool being driven in rotation by means of a drive shaft which can be connected in a rotationally fixed manner to the cleaning tool and which is connected to a motor of the cleaning device by means of transmission elements, for example by means of a belt drive. The drive shaft can be at least partially produced from an electrically conductive material and therefore form a first electrical conductor. In addition, a second electrical conductor can pass through the drive shaft, said second electrical conductor being isolated from the drive shaft. An electrical connection between the sensor device, which is incorporated in the cleaning tool, and the external detector device can be established via the two electrical conductors.

The sensor device preferably has electrical coupling elements for wireless coupling of the sensor device to an external detector device which detects the physical characteristic variable of the sensor element. Optical, inductive or capacitive coupling elements, for example, can be used for this purpose, as can coupling elements which are sensitive to an alternating electromagnetic field, for example antennas. A wireless transmission channel can be set up between the sensor device of the cleaning tool and the external detector device by means of the electrical coupling elements. In particular, this provides a way of establishing a radio connection between the two devices.

In a particularly preferred refinement of the cleaning tool according to the invention, the sensor device of said cleaning tool has at least one electrical memory element, for example a write/read memory which can be written to and read from. This provides a way of storing tool-specific data or a computer program in the sensor device. For example, an identification number of the cleaning tool can be stored in the sensor device, the identification number unambiguously characterizing the cleaning tool. This identification number can be read and evaluated by the detector device which is associated with the sensor device.

It is expedient if the sensor device is programmable.

The sensor device can comprise, for example, a microelectronic circuit which is electrically connected to the sensor element.

In a particularly preferred refinement of the invention, the sensor device has a transponder, that is to say a radio communications element which receives and responds to incoming signals. A wireless transmission channel can be created between the sensor device of the cleaning tool and an external detector device by means of the transponder. The transponder has a data memory in the form of a write/read memory and may additionally also comprise a control logic means. Said transponder can be electrically connected to a transceiver antenna. The transponder preferably has an antenna coil. The transponder can be supplied with power and its data memory can be read by virtue of said transponder being inductively coupled to an associated read device. However, provision may also be made for the transponder to be equipped with its own power source. Such combinations of a transponder and a read device are generally known under the term RFID (Radio Frequency Identification) technology.

It is particularly advantageous if the sensor element has an electrical conductor loop which is connected into the antenna of the transponder and which can be interrupted when a predefined degree of wear of the cleaning tool is reached. If the cleaning tool has reached the predefined degree of wear, the electrical conductor loop is interrupted. As a result, the transmission of data between the transponder and an associated read device is at least adversely affected or even completely interrupted. The adverse effect on or interruption in data transmission can be identified by the associated detector device which has the read device that interacts with the transponder. An indicator device which is connected to the detector device can then indicate that the cleaning tool has reached its predefined degree of wear. Since data is not transmitted between the read device and the transponder if no cleaning tool has been installed in the cleaning device, the lack of transmission of data can also indicate to the user that a cleaning tool has inadvertently not been installed in the cleaning device and operation of said cleaning device is therefore not possible.

As an alternative, provision may be made for the transponder to have an electrical circuit to which the sensor element and the antenna are connected, it being possible for the electrical circuit to sense the change in the physical characteristic variable of the sensor element and output a corresponding signal to the antenna. The sensor element can be formed, for example, as a conductor loop which is interrupted when there is a predefined degree of wear of the cleaning tool. The interruption in the conductor loop is identified by the electrical circuit of the transponder and signaled to the associated read device via the antenna. In a refinement of this type, the antenna is not adversely affected by the sensor element, and a radio connection between the read device and the transponder is ensured by means of the antenna, independently of the degree of wear of the cleaning tool. Therefore, the transponder can be interrogated by the read device at any time, data, for example identification numbers, can be exchanged, and also the change in the physical characteristic variable of the sensor element can be signaled to the read device independently of the above.

The transponder can be disposed on or in the cleaning tool in various ways. It is advantageous if, after the installation of the cleaning tool in the cleaning device, there is as small a spacing as possible between the antenna of the transponder and the antenna of the associated read device of the detector device. Therefore, provision may be made, for example, for the cleaning tool to be able to rotate about a rotation axis and have a base body with an annular region which is aligned coaxially with the rotation axis, and for the antenna of the transponder to be disposed in this region. In the mounted state of the cleaning tool, the annular region of the base body can enter an associated receiving ring of the cleaning device, and the antenna of the read device of the detector device, which read device interacts with the transponder, can be integrated in the receiving ring. As a result, a very small spacing can be created between the antennas and consequently good signal transmission can be achieved, without adversely affecting the cleaning effect of the cleaning tool. Provision may also be made for the annular region to be situated opposite a supporting plate of the cleaning device in the mounted state of the cleaning tool. The antenna of the read device can be disposed on the supporting plate, so that good signal transmission can be achieved between the transponder and the read device.

Up to this point, no detailed information has been given about the position of the sensor element on or in the cleaning tool. In an advantageous embodiment, provision is made for the cleaning tool to be able to rotate about a rotation axis and to have a base body which is aligned coaxially with the rotation axis and from which the sensor element projects radially or axially in relation to the rotation axis.

In order to mount the sensor element, it is advantageous if said sensor element can be latched or clamped to the base body. The sensor element can be mounted, for example, on a mount which can be inserted into a corresponding receptacle in the base body and latched to said base body.

The sensor element is preferably of flexible form, that is to say it can be deformed, in particular it can be bent.

In order to protect the sensor element against severe adverse mechanical effects during operation of the cleaning tool, it is advantageous if cleaning elements of the cleaning tool are disposed ahead of and behind the sensor element in the direction of rotation of the cleaning tool. The cleaning tool can be configured, for example, in the form of a disk or roller brush with a base body from which a large number of cleaning bristles project. The cleaning bristles form cleaning elements between which the sensor element is disposed and on which the sensor element can be supported during rotation of the disk or roller brush.

In order to improve the supporting and protective functions, a thicker bristle arrangement, that is to say a higher density of cleaning bristles, can be provided ahead of and behind the sensor element in the direction of rotation of the cleaning tool.

In an advantageous embodiment, the sensor element is disposed on a foil printed circuit. In this case, a foil printed circuit is understood to be a flexible electrical printed circuit board, that is to say a thin, flexible foil which can be bent.

In an advantageous embodiment, a transponder, which is electrically connected to the sensor element, is disposed on the foil printed circuit, that is to say the foil printed circuit is provided with both the sensor element and the transponder.

The foil printed circuit is preferably mounted on a carrier which can be axially inserted into a base body of the cleaning tool. The carrier can form a sleeve on which the foil printed circuit can be fixed, in particular wound. The carrier may be of annular configuration, for example, and can be connected to the base body in the axial direction in relation to the rotation axis of said base body. The carrier preferably has a supporting element on which the sensor element rests.

As already explained, the cleaning tool can be formed as a rotatably mounted roller brush with a cylindrical base body from which a large number of cleaning bristles project outward, the sensor element being disposed between the cleaning bristles.

As an alternative, the cleaning tool can be formed as a rotatably mounted disk brush with a plate-like base body, from the lower face of which a large number of cleaning bristles project, the sensor element being disposed between the cleaning bristles.

As mentioned in the introductory part, the invention also relates to a cleaning device for cleaning a surface, in particular a floor surface, having a cleaning tool which is subject to wear during operation. The cleaning device has at least one cleaning tool of the above-described type and a detector device which is coupled to the sensor device for the purpose of sensing the change in the physical characteristic variable of the sensor element, and the cleaning device also has an indicator device which is connected to the detector device and on which wear of the cleaning tool can be optically and/or acoustically indicated.

The cleaning device allows a user to easily identify wear of the cleaning tool. To this end, the cleaning tool is, as explained above, equipped with a sensor element which has a physical characteristic variable which changes as a function of the wear of the cleaning tool. The change in the characteristic variable can be identified by the detector device of the cleaning device, said detector device being coupled to the sensor device of the cleaning tool in a contact-free or contact-making manner for this purpose. In the event of a change in the characteristic variable, an indicator device can indicate to the user that a specific degree of wear of the cleaning tool has been reached.

The detector device preferably has an evaluation electronics system which is integrated in a control device of the cleaning device and is connected to the sensor device which is integrated in the cleaning tool by means of contact-free or contact-making contact elements. In particular, provision may be made for the detector device to be connected to the sensor device via electrical lines.

The detector device preferably comprises electrical coupling elements for wireless coupling of the detector device to the sensor device of the cleaning tool. Optical, inductive or capacitive coupling elements, for example, can be used for this purpose, as can coupling elements which are sensitive to an alternating electromagnetic field, in particular transmitters and/or receivers of radio signals, for example an antenna.

In an advantageous refinement of the cleaning device according to the invention, the detector device comprises a coil which surrounds, in the circumferential direction, an annular portion of a base body of the cleaning tool. The coil permits the detector device to be inductively coupled to the sensor device of the cleaning tool.

Provision may also be made for the detector device to have a read device for reading a transponder of the cleaning tool. To this end, the read device comprises an antenna, preferably an antenna coil, which can be used to set up a bidirectional contact-free transmission channel between the read device and the transponder. In particular, a data memory of the transponder can be read or written to by means of the read device.

The antenna of the read device is preferably disposed at as small a spacing as possible from the antenna of the transponder of the cleaning tool. Therefore, provision may be made, for example, for the read device antenna to be disposed on or in a housing of the cleaning device, said housing accommodating the cleaning tool, in particular on or in a top wall of the housing which covers the cleaning tool.

It is particularly advantageous if the antenna of the read device is disposed on or in a ring which surrounds a cylindrical edge portion of a base body of the cleaning tool in the circumferential direction. The edge portion of the base body is preferably disposed to be colinear with the ring of the cleaning device; in particular, provision may be made for the edge portion of the base body to enter the ring. The antenna of the transponder of the cleaning device can be positioned on or in the edge portion, and the associated antenna of the read device can be disposed on or in the ring which surrounds the edge portion.

In an advantageous refinement, the cleaning tool is rotatably mounted on a bearing of the cleaning device, and the antenna of the read device is positioned on or in a ring which surrounds the bearing in the circumferential direction. This permits a particularly small spacing between the antenna of the read device and the antenna of the transponder, and therefore permits signal transmission which is particularly insensitive to disturbances.

It is particularly advantageous if the ring which surrounds the bearing of the cleaning device is formed as a thread deflector. Thread deflectors of this kind prevent threads, cords or other elongate articles from wrapping around a drive shaft or a bearing pin of the cleaning tool and thus from having an adverse effect on the rotation of the cleaning tool. Thread deflectors are used, for example, in scrubber dryers and sweeping machines, the cleaning tools of which are in the form of roller brushes. The roller brushes have a cylindrical base body, the end portions of which are each surrounded by an annular thread deflector in the mounted state. The spacing between the thread deflector and the base body is very low; it may be, for example, a maximum of 10 mm, in particular approximately 5 to approximately 10 mm. One of the edge portions of the base body can accommodate a transponder of the sensor device, and the thread deflector which surrounds this end portion can accommodate the associated read device, so that signals can be exchanged between the read device and the transponder by radio in a simple manner. On account of the small spacing between the transponder and the read device, small antennas can be used and, despite this, good signal transmission can be achieved. The sensor element, preferably in the form of a conductor loop, can be connected to the transponder. If the conductor loop is interrupted when a predefined degree of wear is reached, this can have an adverse effect on or even completely interrupt the transmission of signals between the read device and the transponder, and this adverse effect or interruption can be identified by the detector device, and then an optical or acoustic signal can be generated on the indicator device, said signal indicating to the user that the predefined degree of wear of the cleaning tool has been reached. As an alternative, if signal transmission is maintained, the interruption in the conductor loop can be signaled by the transponder by means of the read device of the detector device, said detector device then generating a corresponding signal on the indicator device.

The following description of preferred embodiments of the invention serves, in conjunction with the drawing, to provide a more detailed explanation.

DETAILED DESCRIPTION OF THE INVENTION

Figure 1:
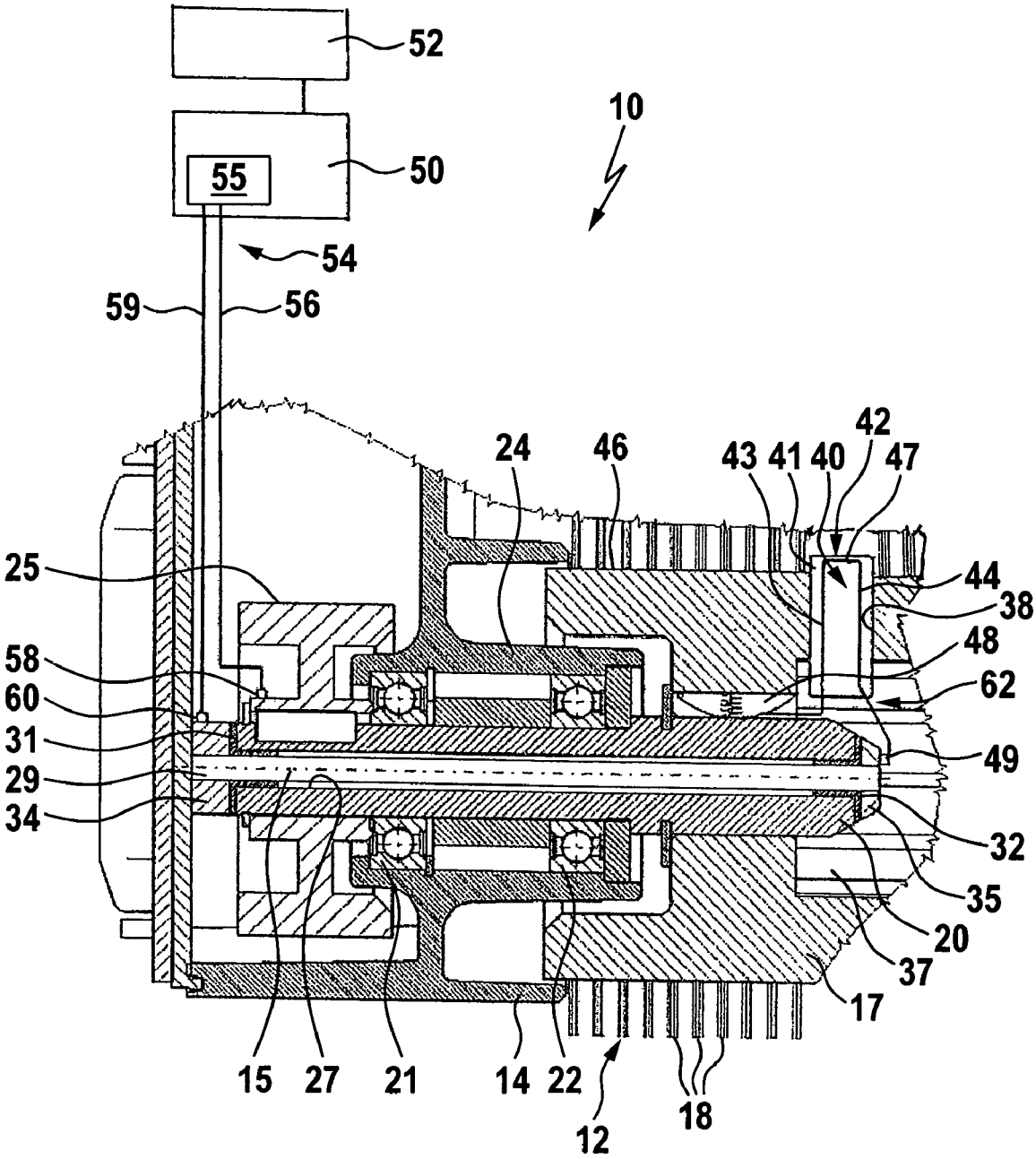
FIG. 1: shows a schematic partial representation of a first embodiment of a cleaning device having a cleaning tool.

FIG. 1 illustrates a first embodiment of a cleaning device according to the invention in the form of a scrubber dryer 10 having a cleaning tool according to the invention in the form of a roller brush 12. The roller brush 12 is, in a customary manner, mounted such that it can rotate about a rotation axis 15 in a housing 14 (only a detail of which housing is shown) which is open at the bottom, and comprises a cylindrical base body 17, from which a large number of cleaning bristles 18 project radially outward. The roller brush 12 can be made to rotate about the rotation axis 15. To this end, a drive shaft 20 axially enters the base body 17 which is in the form of a hollow cylinder, said drive shaft being rotatably mounted in a bearing sleeve 24 by means of a first ball bearing 21 and a second ball bearing 22 and being connected in a rotationally fixed manner to the base body 17 in the customary way. At its free end which is remote from the base body 17, the drive shaft 20 is provided with a belt pulley 25 in a rotationally fixed manner, said belt pulley being coupled in a customary manner to a drive motor of the scrubber dryer 10 (not illustrated in the drawing for the purpose of providing better clarity) by means of a drive belt (likewise not illustrated in the drawing). By means of the drive motor, the roller brush 12 can be made to rotate about the rotation axis 15 by way of the belt pulley 25 and the drive shaft 20.

The drive shaft 20 is made from an electrically conductive material, preferably from a metal, and has a through hole 27, which runs coaxially with the rotation axis 15. A metal rod 29 passes through the through hole 27, said metal rod being held at a spacing from the drive shaft 20 by means of a first insulating sleeve 31 and a second insulating sleeve 32 and thus being isolated from said drive shaft. The metal rod 29 projects beyond the drive shaft 20 in the axial direction both by way of its first end, which is remote from the roller brush 12, and by way of its second end which enters the base body 17 of the roller brush 12. The metal rod 29 is provided with a first contact ring 34 at its first end, and the metal rod 29 is provided with a second contact ring 35 at its second end.

The base body 17 defines a cavity 37. Starting from the cavity 37, the base body 17 has a radially oriented passage 38 through which a sensor element 40 passes. Said sensor element comprises a foil printed circuit 41 on which a U-shaped conductor loop 42 is disposed. The conductor loop has a first limb 43 and a second limb 44, said limbs being connected to one another by means of a cross-piece 47 in the region between the cleaning bristles 18 outside the base body 17. A first sliding contact 48, which makes contact with the outer face of the drive shaft 20 within the base body 17, is connected to the first limb 43, and a second sliding contact 49, which makes contact with the front face of the second contact ring 35, is connected to the second limb 44. Therefore, the conductor loop 42 is electrically connected to the drive shaft 20 and to the metal rod 29 by means of the sliding contacts 48 and 49.

For the purpose of electrical control, the scrubber dryer 10 has a control device 50 which is connected to an indicator device in the form of a display 52. An evaluation electronics system 55 of a detector device 54 is integrated in the control device 50, said evaluation electronics system being connected to the belt pulley 25 by means of a first connection line 56 and a third sliding contact 58, said belt pulley for its part being electrically connected to the drive shaft 20. In addition, the evaluation electronics system 55 is connected to the first contact ring 34 by means of a second connection line 59 and a fourth sliding contact 60, said first contact ring being electrically connected to the metal rod 29. The evaluation electronics system 55 is therefore connected to the first limb 43 of the conductor loop 42 by means of the first connection line 56, the third sliding contact 58, the belt pulley 25, the drive shaft 20 and the first sliding contact 48, and the evaluation electronics system 55 is electrically connected to the second limb 44 of the conductor loop 42 by means of the second connection line 59, the fourth sliding contact 60, the first contact ring 34, the metal rod 29, the second contact ring 35 and the second sliding contact 49.

The sensor element 40 with the conductor loop 42 forms, in combination with the two sliding contacts 48 and 49, a sensor device 62 which is integrated in the base body 17 of the roller brush 12 and is therefore electrically conductively connected to the detector device 55 by means of the abovementioned lines.

During operation of the scrubber dryer 10, the cleaning bristles 18 of the cleaning brush 12 gradually wear away, that is to say they become increasingly shorter. As a result, during long-term operation of the roller brush 12, the cleaning bristles 18 have, at their free end, virtually the same spacing from the outer face 46 of the base body 17 as that end of the foil printed circuit 41 which projects outward. In the course of further operation, this results in the foil printed circuit 41 making contact with the surface to be cleaned in the same way as the cleaning bristles 18. In the process, the foil printed circuit 41 is mechanically damaged and, after a short time, the conductor loop will be interrupted in the region of the cross-piece 47. The interruption in the conductor loop 42 is identified by the evaluation electronics system 55 on account of the now missing connection between the first connection line 56 and the second connection line 59 by means of the conductor loop 42. A signal is then transmitted to the display 52, so that the display 52 indicates to the user that a degree of wear of the roller brush 12 has been reached, which degree of wear is predefined by the radial positioning of the foil plate 41 in the passage 38. Therefore, it is not necessary for the user, before the beginning of operation of the scrubber dryer 10, to check the roller brush 12 as to whether the cleaning bristles 18 have worn away to such an extent that the floor surface to be cleaned may be damaged or at least an inadequate cleaning result may be achieved, and instead the display 52 indicates to the user that the predefined degree of wear has been reached. If operation of the scrubber dryer 10 is erroneously started without the roller brush 12 being mounted in the housing 14, this would likewise be indicated to the user on the display 52 since there is no electrical connection between the two connection lines 56 and 59 in this case either.

Figure 2:
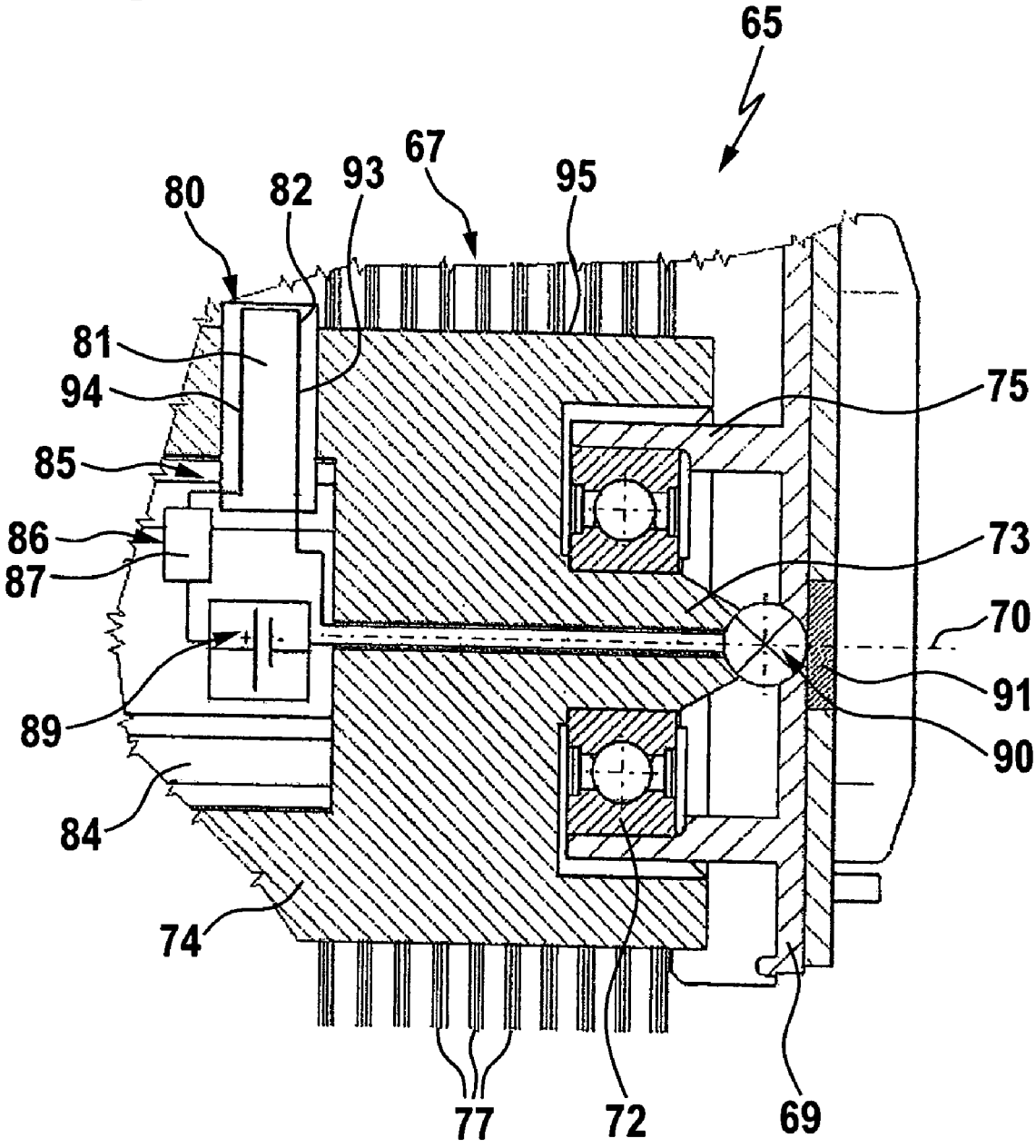
FIG. 2: shows a schematic partial representation of a second embodiment of a cleaning device having a cleaning tool.

A second embodiment of a cleaning device according to the invention in the form of a scrubber dryer 65 having a cleaning tool according to the invention in the form of a roller brush 67 is schematically illustrated in FIG. 2. The roller brush 67 is mounted such that it can rotate about a rotation axis 70 in a housing 69 which is open at the bottom. The roller brush 67 is driven in rotation by means of a drive shaft in the same way as in the case of the roller brush 12 illustrated in FIG. 1. The drive shaft is not illustrated in FIG. 2; instead FIG. 2 shows that end face of the roller brush 67 which is remote from the drive shaft. This end face is rotatably mounted on a bearing sleeve 75 of the housing 69 by means of a ball bearing 72 which surrounds a bearing pin 73 of the base body 74 of the roller brush 67. A large number of cleaning bristles 77 project radially outward from the base body 74 of the roller brush 67, in the same way as from the base body 17 of the above-described roller brush 12, and a sensor element 80, which is identical to the sensor element 40, is disposed between the cleaning bristles 77, said sensor element having a foil printed circuit 81 which is provided with a conductor loop 82. In the embodiment illustrated in FIG. 2, the cavity 84, which is defined by the hollow-cylindrical base body 74 of the roller brush 67, contains not only a sensor device 85 with the sensor element 80, but also a detector device 86 with an evaluation electronics system 87 and a power source in the form of a battery 89. The roller brush 67 also has an indicator device in the form of a monitoring lamp 90 which is disposed at the free end of the bearing pin 73 and can be observed by the user through a viewing window 91. The monitoring lamp 90 is connected on one side to the battery 89 and to the evaluation electronics system 87 on the other side. The evaluation electronics system is electrically connected to the first limb 94 and to the second limb 93 of the conductor loop 82 and is connected to the battery 89.

If the cleaning bristles 77 are worn away to such an extent that their free end does not project any further from the outer face 95 of the base body 74 than the free edge of the foil printed circuit 81, both the cleaning bristles 77 and additionally also the foil printed circuit 81 are mechanically damaged during the further course of operation of the scrubber dryer 65, until the conductor loop 82 is interrupted. The interruption in the conductor loop 82 is identified by the detector device 86 which then actuates the monitoring lamp which is, for example, in the form of an incandescent lamp or a light-emitting electrode, so that said monitoring lamp emits an optical signal which can be identified by the user. The user therefore receives the signal that the degree of wear of the roller brush 67 which is predefined by the radial position of the sensor element 80 has been reached, and said roller brush has to be replaced.

Figure 3:
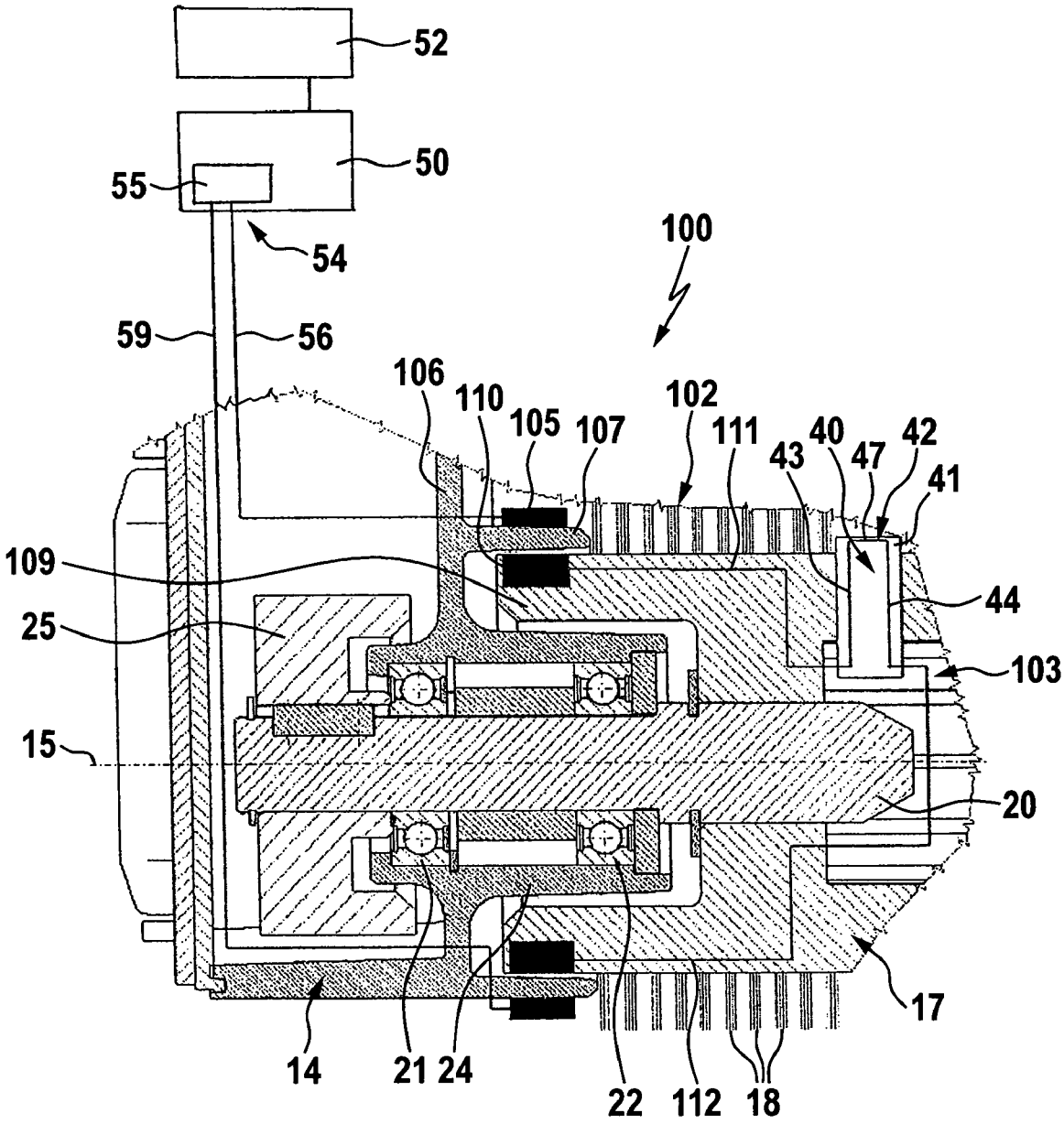
FIG. 3: shows a schematic partial representation of a third embodiment of a cleaning device having a cleaning tool.

FIG. 3 illustrates a third embodiment of a cleaning device according to the invention in the form of a scrubber dryer 100 having a cleaning tool according to the invention in the form of a roller brush 102. The scrubber dryer 100 and the roller brush 102 are largely identical to the scrubber dryer 10 and the roller brush 12 illustrated above with reference to FIG. 1. Therefore, in FIG. 3, identical components are provided with the same reference symbols as in FIG. 1 and reference is made to the above explanations in relation to these components in order to avoid repetition.

In contrast to the scrubber dryer 10, in the case of the scrubber dryer 100, the detector device 54 is connected to the sensor device 103, which is incorporated in the roller brush 102, by means of inductive coupling elements. To this end, the scrubber dryer 100 has a first coil 105 which surrounds, in the circumferential direction, an annular coil carrier 107, which projects from a housing wall 106 in the manner of a collar. The coil carrier 107 is aligned coaxially with the bearing sleeve 24, and a cylindrical edge portion 109 of the base body 17 of the roller brush 102 enters the annular coil carrier 107. In its region which enters the coil carrier, the edge portion 109 is provided with a second coil 110, the ends of said second coil being connected to the conductor loop 42 of the sensor element 40 of the roller brush 102 by means of connection lines 111 and 112.

The second coil 110 forms a component of the sensor device 103 which is incorporated in the roller brush 102, said sensor device comprising the sensor element 40 in addition to the second coil 110. The second coil 110 is shorted by means of the conductor loop 42 of the sensor element 40.

During operation of the scrubber dryer 100, the roller brush 102 rotates about its rotation axis 15, and the second coil 110 executes a corresponding rotary movement within the first coil 105. As a result of rotary movement of the second coil 110, an electric voltage is induced in the first coil 105, it being possible for said electric voltage to be sensed by the detector device 55.

If the conductor loop 42 of the sensor element 40 of the roller brush 102 is interrupted after corresponding wearing away of the cleaning bristles 18 of the roller brush 102, as has been explained in detail above with reference to FIG. 1, this results in a change in the voltage induced in the first coil 105. This change in voltage is likewise sensed by the detector device 55 which then sends a signal to the display 52, so that said display indicates to the user the information that a degree of wear of the roller brush 102 has been reached, which degree of wear is predefined by the radial position of the sensor element 40 in the base body 17 of the roller brush 102. The user can then replace the roller brush 102.

When a predefined degree of wear is reached, as explained above, the conductor loop 42 is interrupted. Therefore, the ohmic resistance of the conductor loop 42, and therefore a physical characteristic variable of the sensor element 40, change abruptly. This change in the characteristic variable is, as explained above, inductively sensed by the detector device 54 by means of the electrical contact elements in the form of the first coil 105 and the second coil 110, and then indicated to the user on the display 52.

Figure 4:
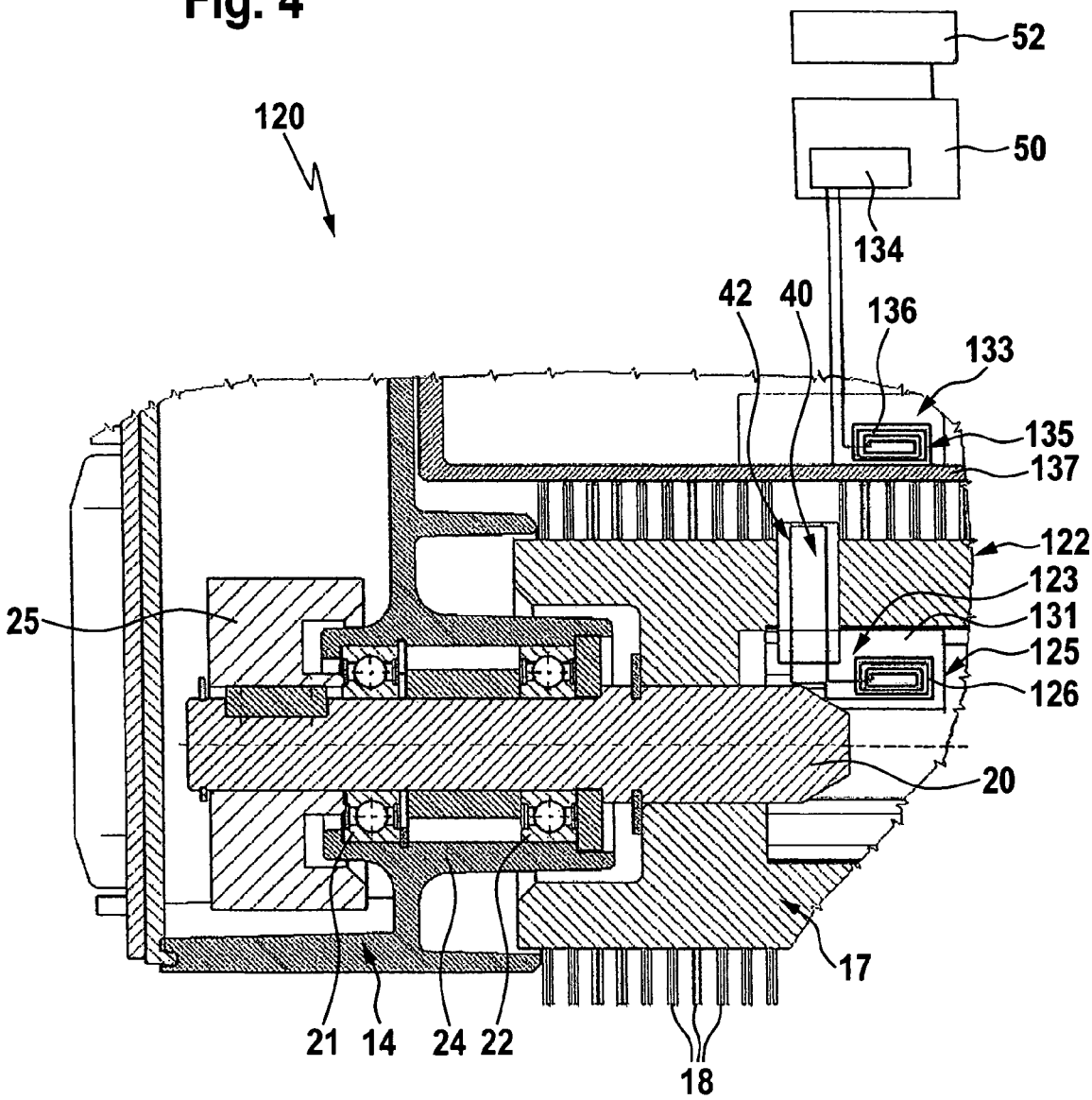
FIG. 4: shows a schematic partial representation of a fourth embodiment of a cleaning device having a cleaning tool.

FIG. 4 illustrates a fourth embodiment of a cleaning device according to the invention in the form of a scrubber dryer 120 having a cleaning tool according to the invention in the form of a roller brush 122. The scrubber dryer 120 and the roller brush 122 are largely identical to the scrubber dryer 10 and the roller brush 12 explained above with reference to FIG. 1. Therefore, in FIG. 4, the same reference symbols as in FIG. 1 are used for identical components and reference is made to the above explanations in relation to these components in order to avoid repetition.

Figure 5:
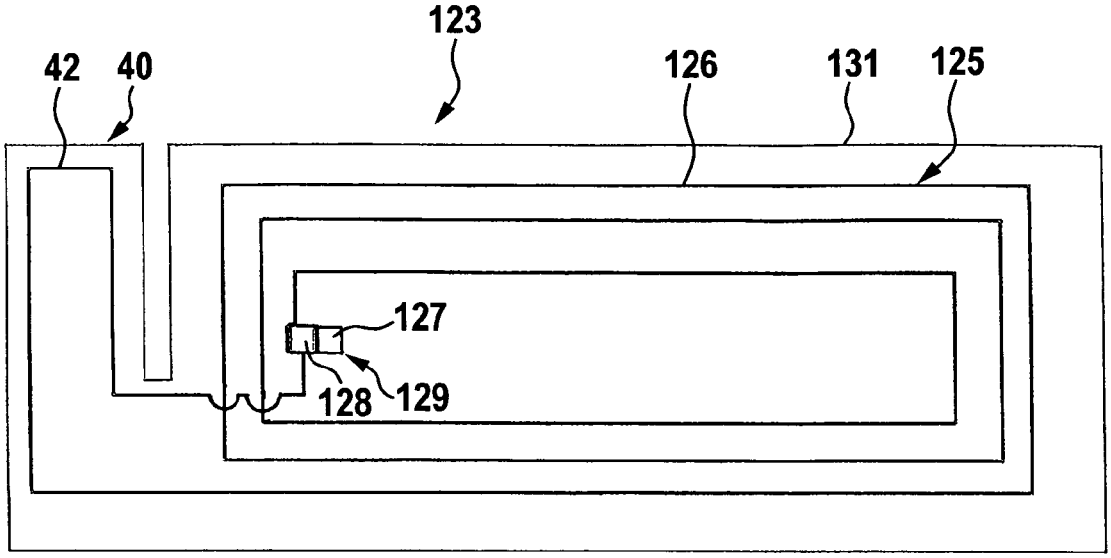
FIG. 5: shows a schematic representation of a first possible way of connecting a sensor element to a transponder.

The roller brush 122 has a sensor device 123 with a sensor element 40 which, as has already been explained in detail, has a conductor loop 42. In addition, the sensor device 123 comprises a transponder 125. As is clear from FIG. 5, the transponder 125 comprises an antenna coil 126, a write/read memory 127 and a control logic means 128. The write/read memory 127 and the control logic means 128 are part of a microelectronic circuit 129 which, like the antenna coil 126 and the conductor loop 42 of the sensor element 40, is disposed on a common foil printed circuit 131. The conductor loop 42 is connected in series with the antenna coil 126. If the conductor loop 42 is interrupted when a predefined degree of wear of the roller brush 122 is reached, as explained above, the transmission and reception properties of the antenna coil 126 therefore change.

In a corresponding manner, as has been explained above, the sensor device 123 which is integrated in the roller brush 122 also has an associated external detector device 133. Said detector device comprises an evaluation electronics system 134, which is integrated in the control device 50 of the scrubber dryer 120, and a read device 135 having an antenna coil 136 which interacts in a contact-free manner with the antenna coil 126 of the transponder 125 of the sensor device 123 by means of exchange of radio signals. The read device 135 is disposed on a top wall 137 of the housing 14 which accommodates the roller brush 122. The read device 135 can be used to read the write/read memory 127 of the transponder 125 in a contact-free manner. Tool-specific data can be stored in the write/read memory 127 in order to identify the roller brush 122.

If the conductor loop 42 of the sensor element 40 is interrupted when a degree of wear of the roller brush 122 is reached, said degree of wear being predefined by the radial disposition of the sensor element 40 in the base body 17 of the roller brush 122, the transmission and reception properties of the antenna coil 126 therefore change suddenly, so that radio signals can be transmitted at best with poor quality between the read device 135 and the transponder 125. In particular, provision may be made, when the conductor loop 142 is interrupted, for the read device 135 to no longer be able to identify the transponder 125 at all since it no longer receives a response signal from the transponder 125. Signal transmission between the read device 135 and the transponder 125 which is adversely affected or even completely interrupted is identified by the evaluation electronics system 134 of the detector device 133. The display 52 which is connected to the control device 50 of the scrubber dryer 120 then optically indicates to the user that the predefined degree of wear has been reached. In a corresponding manner, the lack of a roller brush 122 is also indicated if the scrubber dryer 120 has been erroneously operated without the roller brush 122 having been mounted in the housing 14 beforehand.

Figure 6:
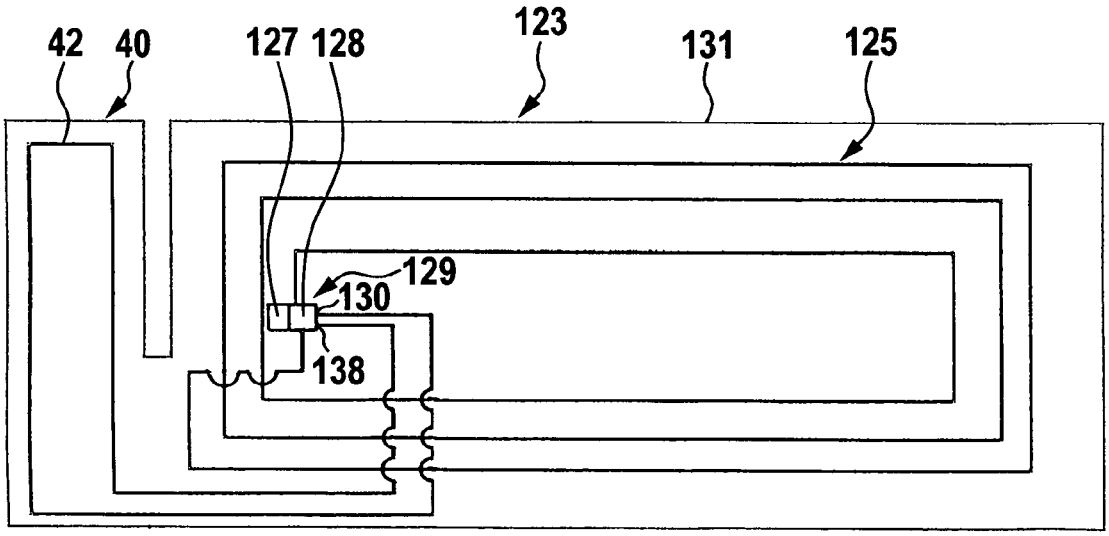
FIG. 6: shows a schematic representation of a second possible way of connecting a sensor element to a transponder.

FIG. 6 schematically illustrates an alternative connection arrangement for the transponder 125. In contrast to the connection arrangement according to FIG. 5, in FIG. 6 the conductor loop 42 is not connected to the antenna coil 126 in series but is connected to separate inputs 130, 138 of the control logic means 128. If the conductor loop 42 is interrupted when a predefined degree of wear is reached, this is identified by the control logic means 128 and signaled to the read device 135 by means of the antenna coil 126. In the case of the connection arrangement of the write/read memory 127 illustrated in FIG. 6, information can be read from the read device 135 even when the conductor loop 42 is interrupted since signal transmission between the read device 135 and the transponder 125 is not adversely affected by the interruption in the conductor loop 42.

Figure 7:
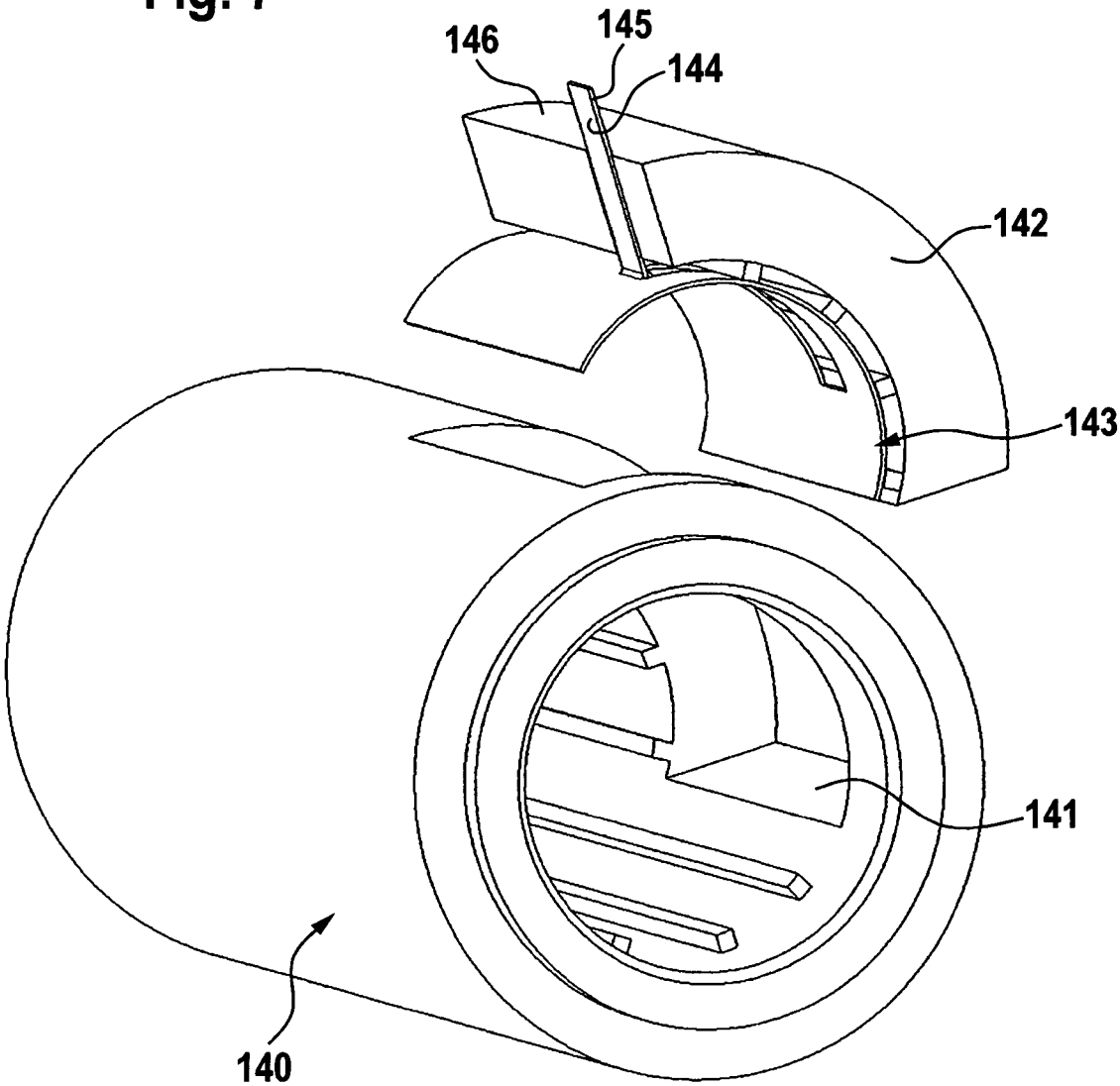
FIG. 7: shows a schematic representation of a first variant for mounting a sensor element on a base body of a cleaning tool.

Up until this point, no further information has been provided about how the sensor element 40 or the sensor element 80, which is explained with reference to FIG. 2, are disposed and fixed. FIG. 7 schematically illustrates a first option for disposing and mounting a sensor element on a base body 140. The base body 140 can be produced, for example, from a plastics material on which cleaning bristles 18 or 77 can be fixed, in a subsequent production step which is not illustrated in the drawing, such that they project radially outward.

The base body 140 has a recess 141 which extends over a subregion of the circumference of said base body and also a subregion of the axial extent of said base body and which is covered by a cover 142. Before the cover 142 is inserted into the recess 141 with an accurate fit, a foil printed circuit 143 is fixed to the lower face of the cover 142, said foil printed circuit having a punched-out, strip-like printed circuit region 144 which is folded radially outward. The punched-out printed circuit region 144 projects, by way of a free end region 145, beyond the outer face 146 of the cover 142 and the remaining portion of the printed circuit region 144 runs between the cover 142 and the edge of the recess 141. The punched-out printed circuit region 144 then forms the above-explained sensor element 40 or 80 and is provided with the conductor loop 42 or 82, while further electrical components of a sensor device can be arranged within the base body 140 on the remaining foil printed circuit 143, in particular the transponder 125 which is explained above with reference to FIG. 4.

Figure 8:
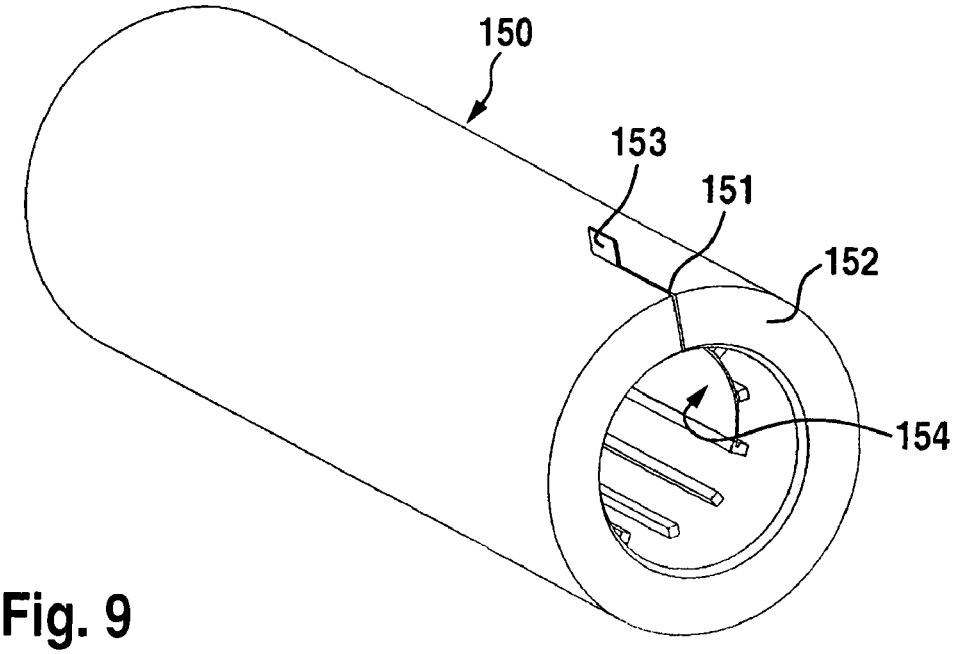
FIG. 8: shows a second variant for mounting a sensor element on the base body of a cleaning tool.

A second advantageous option for disposing and mounting, on a base body of a roller brush, a sensor element which projects radially outward is illustrated in FIG. 8. In this case, a base body 150 is used, said base body having a slot-like recess 151 which runs over a subregion of the longitudinal extent of said base body and starts from an axial end 152 of the base body 150 and extends over a subregion of the entire length of the base body 150. A punched-out printed circuit region 153 of a foil printed circuit 154 is inserted into the recess 151, starting from the axial end 152. By way of a free end, the punched-out printed circuit region 153 projects radially outward beyond the outer face of the base body 150, while the remaining region of the foil printed circuit 154 rests against the inside of the hollow-cylindrical base body 150. The punched-out printed circuit region 153 accommodates the above-explained conductor loop 42 or 82, and the remaining region of the foil printed circuit 154 accommodates further electrical components of the sensor device within the base body 150; in particular, said remaining region can be provided with a transponder 125.

Figure 9:
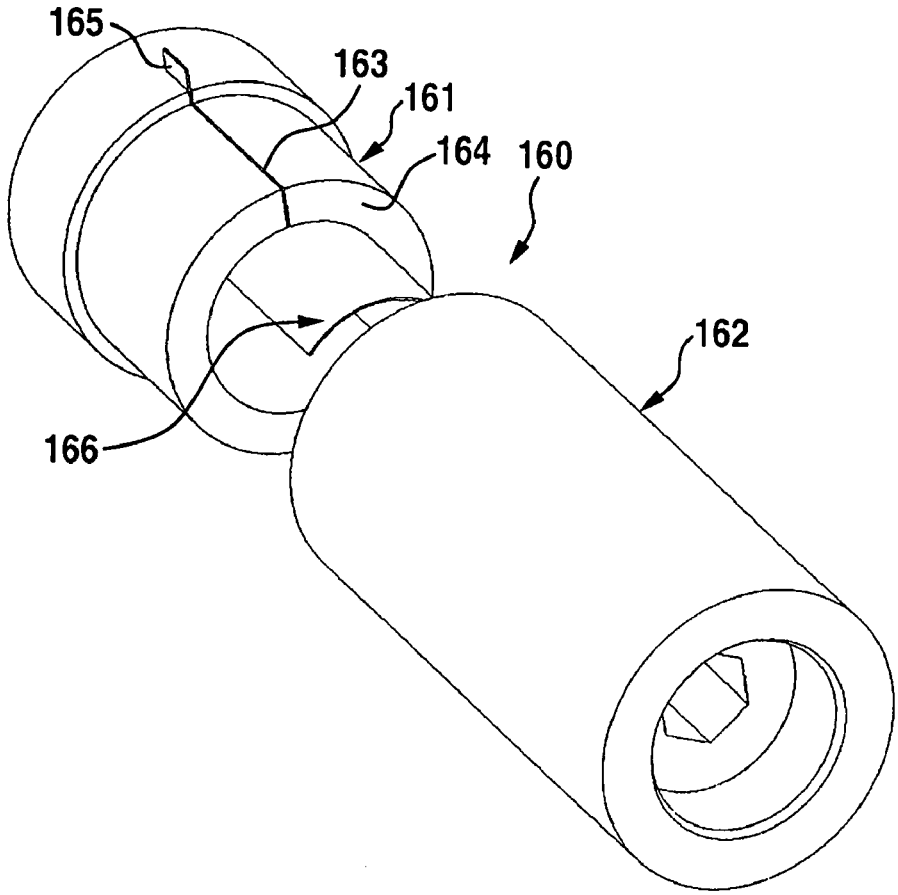
FIG. 9: shows a third variant for mounting a sensor element on the base body of a cleaning tool.

A third option for disposing and mounting a sensor element in the base body of a roller brush is illustrated in FIG. 9. In this case, a two-part base body 160 is used, said two-part base body having a first base body part 161 and a second base body part 162, it being possible for these base body parts to be inserted one into the other in the axial direction. The two base body parts 161 and 162 are hollow. The first base body part 161 has, in a similar manner to the way already explained above with reference to FIG. 6 in the case of the base body 150, a slot-like recess 163 which extends over a subregion of the length of said base body and starts from that end 164 of the first base body part 161 which faces the second base body part 162. A punched-out printed circuit region 165 of a foil printed circuit 166, which is otherwise disposed within the base body 160, is inserted into the slot-like recess 163, so that the free end of the punched-out printed circuit region 165 projects radially outward beyond the outer face of the first base body part 161. The punched-out printed circuit region 165 can once again accommodate a conductor loop which is interrupted when a predefined degree of wear of the corresponding roller brush is reached, and the remaining region of the foil printed circuit 166 can, for example, accommodate a transponder with which an associated read device can make contact, as long as the conductor loop has not yet been interrupted. The two base body parts 161 and 162 can be inserted one into the other after the foil printed circuit 166 has been inserted into the first base body part 161, and then, in a further production step, a large number of cleaning bristles can be fixed to the outer faces of the two base body parts 161 and 162 in order to form a roller brush for a scrubber dryer.

Figure 10:
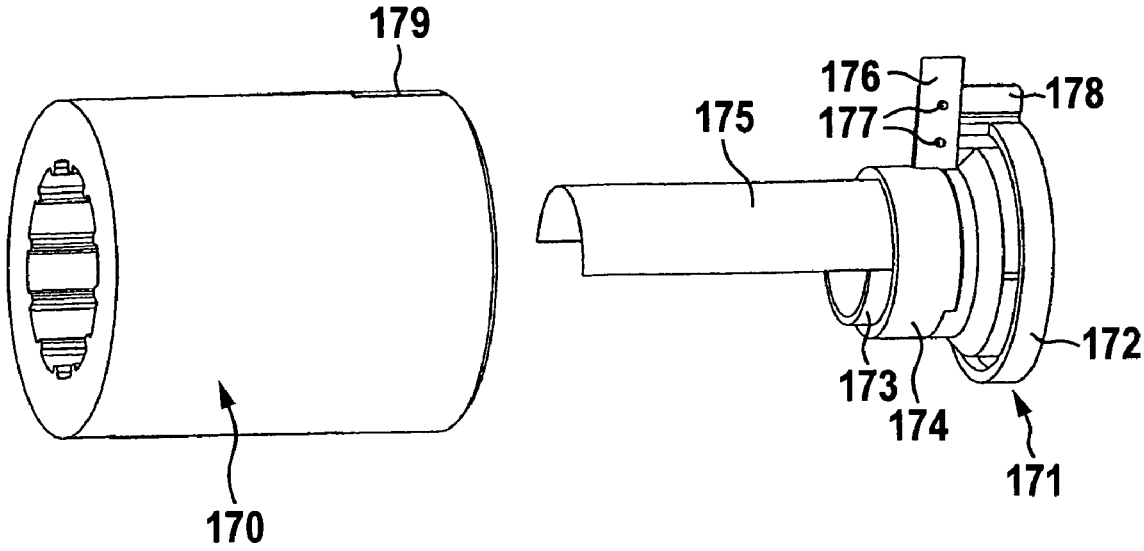
FIG. 10: shows a fourth variant for mounting a sensor element on the base body of a cleaning tool.

A further option for disposing and mounting a sensor element in the base body of a roller brush is illustrated in FIG. 10 using the example of a base body 170 which is configured in the form of a hollow cylinder. An annular carrier 171 can be inserted into the end face of the base body 170, it being possible for the carrier 171 to be press-connected to the base body 170. The carrier 171 comprises an annular part 172 on which an inner sleeve 173 is integrally formed, it being possible for said inner sleeve to be inserted into the base body 170. An outer sleeve 174 is pressed onto the inner sleeve 173 after a foil printed circuit 175 has first been wound onto the inner sleeve 173. A punched-out printed circuit region 176 of the foil printed circuit 175 is routed outward by way of a through slot (not illustrated in the drawing) in the outer sleeve 174 in the manner of a lug and held by means of carrying pins 177 on a plate-like cross-piece 178 which is integrally formed on the annular part 172. When the carrier 171 is inserted into the base body 170, the cross-piece 178 can be introduced into a slot 179 in the base body 170, an end portion of the punched-out printed circuit region 176 then projecting radially outward out of the base body 170. The crosspiece 178 supports the punched-out printed circuit region 176 which, after insertion of the carrier into the base body 170, is clamped-in in a defined manner between one side of the slot 179 and the crosspiece 178, that is to say the position in which the printed circuit region 176 is fixed is unambiguously predefined by the cross-piece 178. The punched-out printed circuit region 176 can be provided with a conductor loop in a manner corresponding to that which has already been described, said conductor loop preferably being electrically connected to a transponder, in particular to its antenna coil, the transponder being disposed on the remaining region of the foil printed circuit 175, as has already been explained above. The carrier 171 can be used in combination with the punched-out printed circuit region 176 and the remaining region of the foil printed circuit 175 for base bodies of different thicknesses. To this end, it is only necessary for the corresponding end face, with which the carrier 171 is to be press-connected, to be formed to complement the carrier 171 of the base body. This provides a simple way of equipping roller brushes of different diameters with a sensor device, a physical characteristic variable of the sensor device, for example the ohmic resistance of a conductor loop, experiences an abrupt change when a predefined degree of wear of the roller brush is reached, it being possible for this change in the characteristic variable to be sensed, preferably in a contact-free manner, by an associated detector device.

Figures 11A, 11B, 11C:
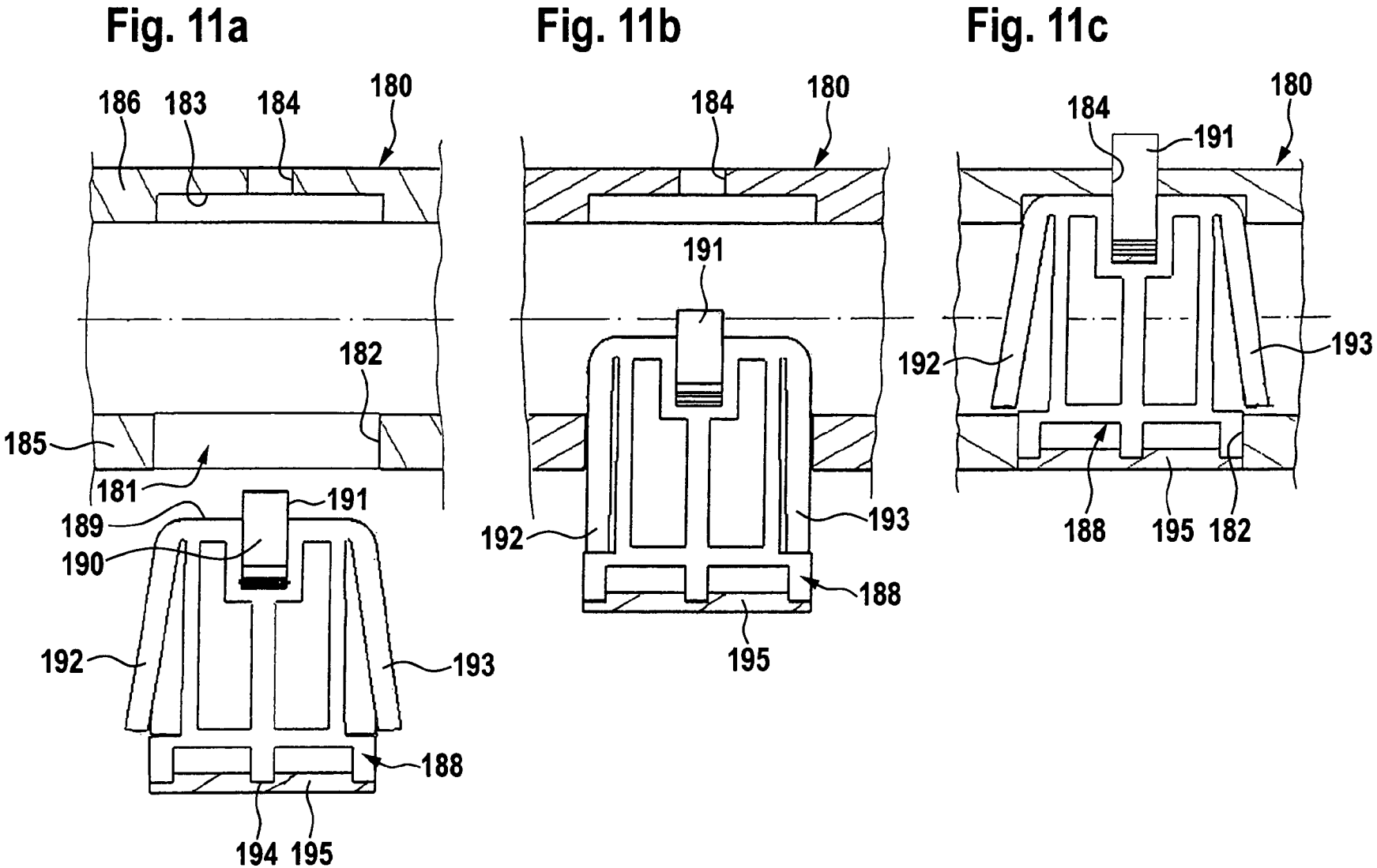
FIG. 11A, show a fifth variant for mounting a sensor element 11B and 11C: on the base body of a cleaning tool.

FIGS. 11A, 11B and 11C schematically illustrate a further option for disposing and mounting a sensor element in the base body of a roller brush using the example of a base body 180. Only a detail of said base body is illustrated in FIGS. 11A to 11C. It is clear that said base body is in the form of a hollow cylinder and has a stepped recess 181 which runs diametrically and has a first recess portion 182 which merges with a second recess portion 184 by way of a step 183, the second recess portion 184 being considerably smaller than the first recess portion 182. The first recess portion 182 passes through a cylinder wall 185 of the base body 180 and extends diametrically approximately as far as the center of the opposite cylinder wall 186. The step 183 and the second recess portion 184 run in the cylinder wall 186.

A mount 188 can be inserted into the recess 181 in the radial direction, the front face 189 of said mount being provided with a foil printed circuit 190 with a foil strip 191 which projects forward from the front face 189. The mount 188 is produced from an elastically deformable material, in particular from a plastics material, and has a respective latching wing 192 and 193 on outer faces that face away from one another. On the rear face 194, which is remote from the front face 189, the mount 188 is provided with a cover 195. If the mount 188 with the foil printed circuit 190 is inserted into the recess 181, the foil strip 191 passes through the second recess portion 184 and projects, by way of its free end, radially outward beyond the outer face of the base body 180, and at the same time the elastic latching wings 192 and 193 engage behind the cylinder wall 185, and the cover 195 closes the first recess portion 182. The foil printed circuit 190 is therefore reliably fixed in the interior of the hollow-cylindrical base body 180, it being possible, as already described above, for the foil strip 191 which protrudes outward to be provided with a conductor loop which is interrupted when a predefined degree of wear of the corresponding roller brush is reached. The remaining region of the foil printed circuit 190 which is disposed within the base body 180 can once again be provided with a transponder which is electrically connected to the conductor loop.

Figure 12:
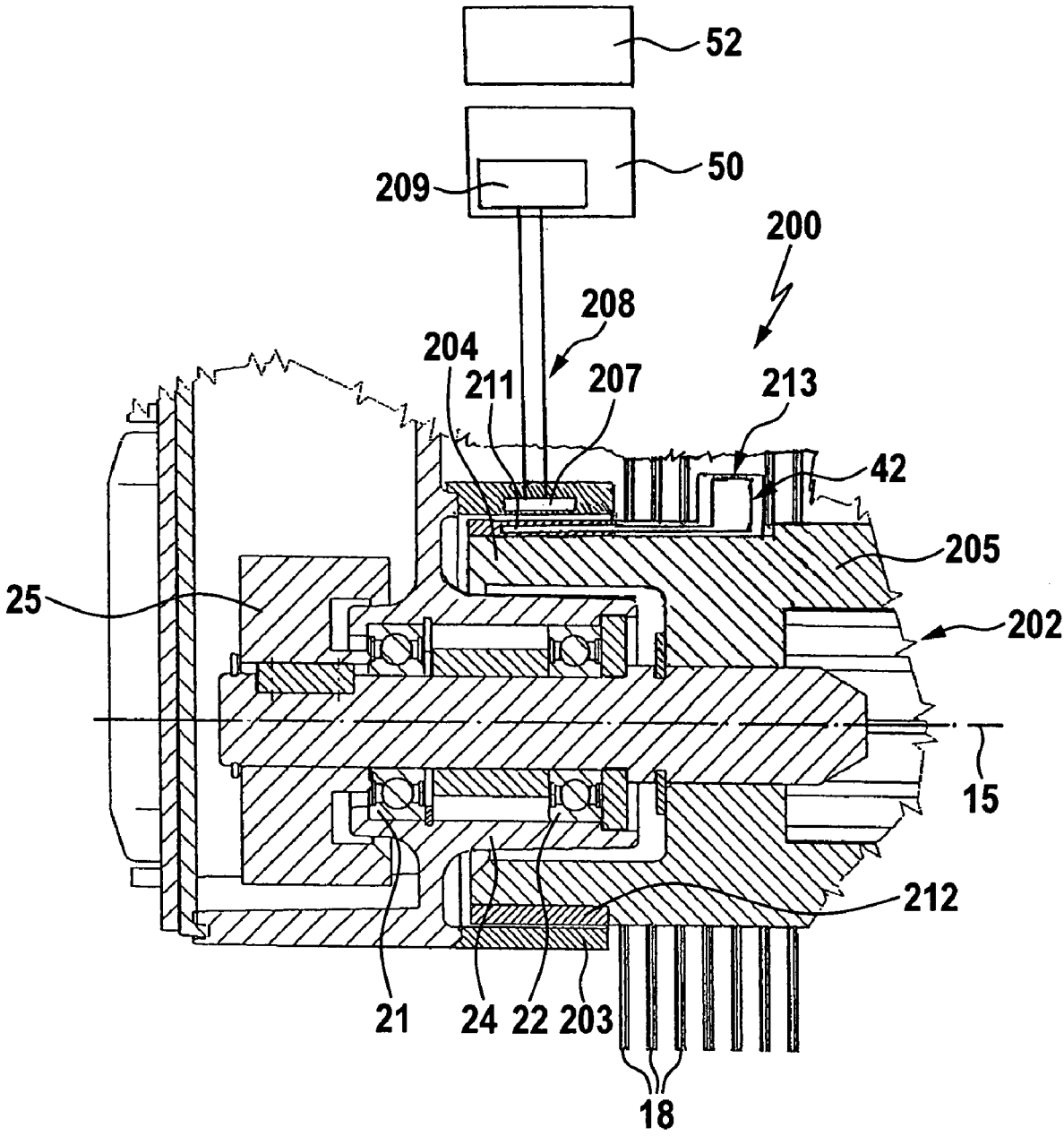
FIG. 12: shows a schematic partial representation of a fifth embodiment of a cleaning device having a cleaning tool.

In many cases, the bearing regions of known roller brushes are surrounded by a so-called thread deflector which is intended to prevent threads or cords from wrapping around the drive shaft and the bearing of the roller brush, this possibly having an adverse effect on the rotary movement of the roller brush. A corresponding refinement of a cleaning device according to the invention in the form of a scrubber dryer 200 having a cleaning tool in the form of a roller brush 202 is schematically illustrated in FIG. 12. The scrubber dryer 200 is largely identical to the scrubber dryers 10, 100 and 120 explained above with reference to FIGS. 1, 3 and 4. Therefore, in FIG. 10, the same reference symbols as in FIGS. 1, 3 and 4 are used for identical components and reference is made to the above explanations in relation to these components in order to avoid repetition.

The scrubber dryer 200 has an annular thread deflector 203 which surrounds a cylindrical edge portion 204 of a base body 205 of the roller brush 202 in the circumferential direction. A read device 207 of a detector device 208 is integrated in the thread deflector 103, said detector device having, in addition to the read device 207, an evaluation electronics system 209 which is integrated in the control device 50 of the scrubber dryer 200.

The read device 207 has an associated transponder 211 which is injection molded into a plastics sleeve 212, surrounds the cylindrical edge portion 204 of the base body 205 and is electrically connected to a sensor element 213 which projects axially from the sleeve 212. The sensor element 213 is in the form of a foil printed circuit which, as already explained several times, is provided with a conductor loop.

Disposing the transponder 211 in the sleeve 212, which is disposed the cylindrical edge portion 204 and is surrounded by the annular thread deflector 203 which accommodates the associated read device 207, has the advantage that a very small spacing can be provided between the read device 207 and the transponder 211, in particular a spacing of less than 10 mm. This ensures particularly good signal transmission between the read device 207 and the transponder 212.

Figure 13:
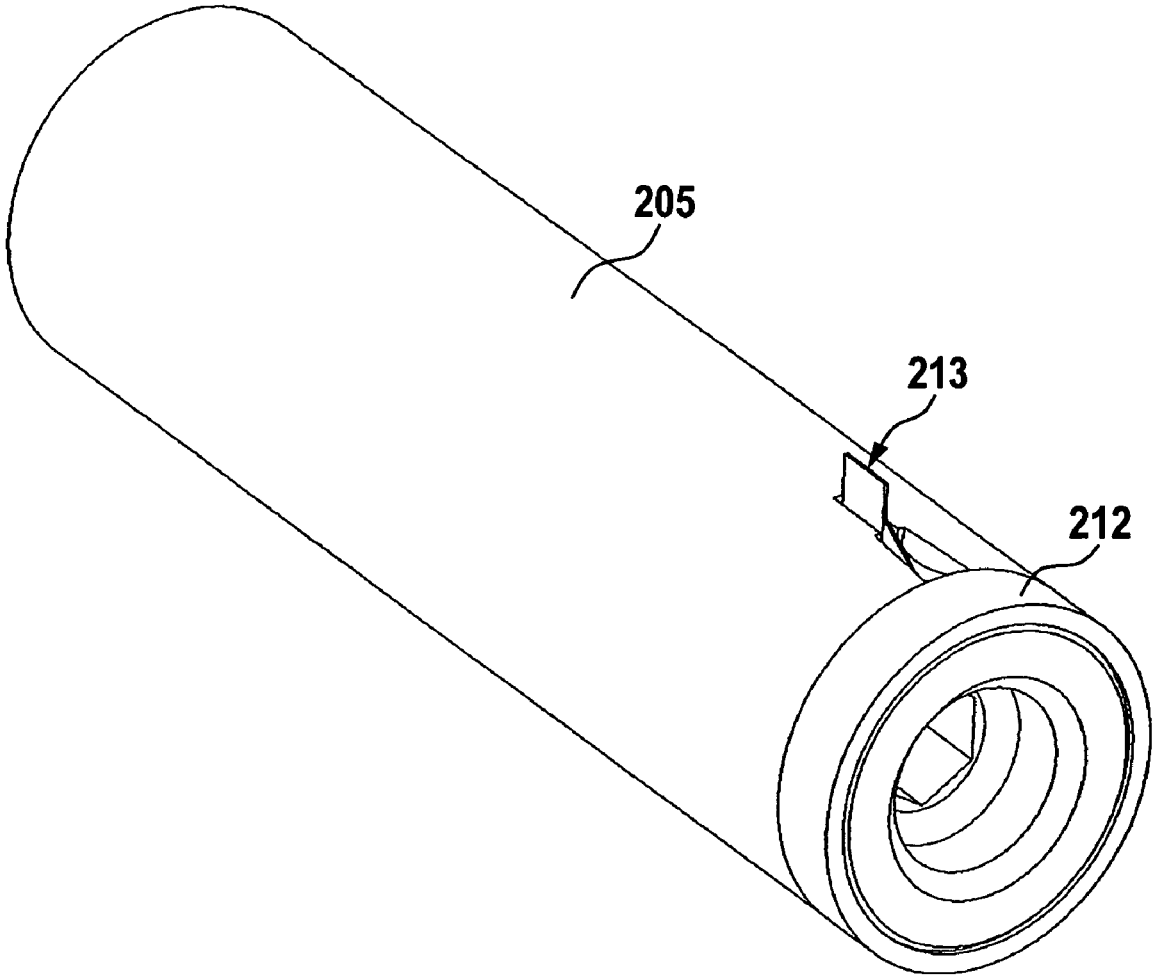
FIG. 13: shows a perspective representation of a base body of the cleaning tool from FIG. 10 having a sensor element.

FIG. 13 schematically illustrates the base body 205 of the roller brush 202 with the sleeve 212 pressed onto the cylindrical edge portion 204, the foil printed circuit with the sensor element 213 projecting in the axial direction from said sleeve.

Figure 14:
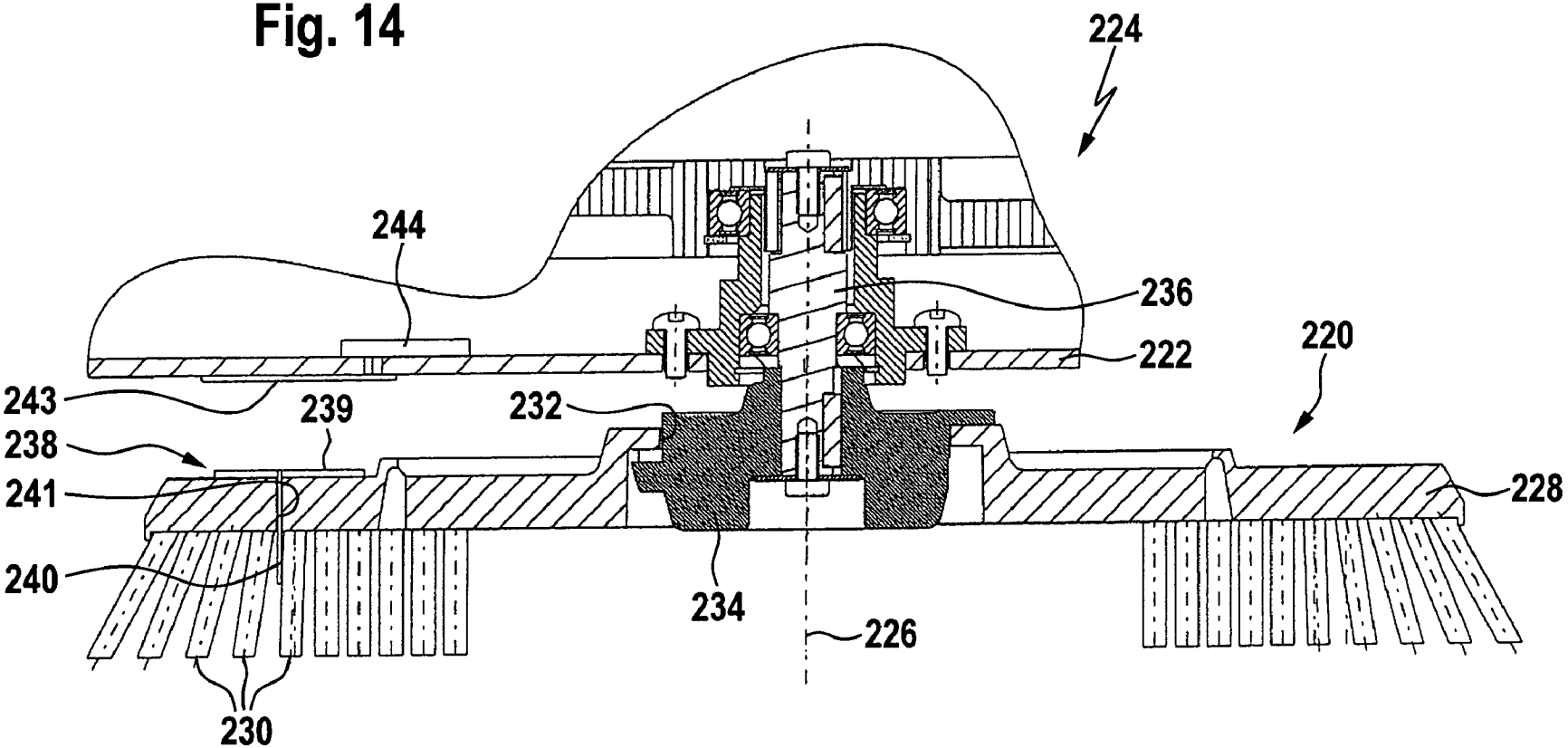
FIG. 14: shows a schematic partial representation of a sixth embodiment of a cleaning device having a cleaning tool.

The refinement according to the invention of a cleaning tool having a sensor device for identifying the degree of wear of the cleaning tool is not restricted to roller brushes as have been explained in detail above. FIG. 14 is a schematic partial illustration of a sixth embodiment of a cleaning device having a cleaning tool, the cleaning tool being configured in the form of a disk brush 220. The disk brush 220 is mounted, on a carrier plate 222 of a cleaning device 224, only a detail of which is illustrated, such that the brush can rotate about a rotation axis 226. Said disk brush comprises a base body in the form of an annular disk 228 which is provided with a large number of cleaning bristles 230 on its lower face, that is to say facing away from the carrier plate 222. The annular disk 228 has a central through opening 232 through which a driver 234 passes, said driver being held on a drive shaft 236 in a rotationally fixed manner. The drive shaft can be made to rotate in a customary manner by a motor of the cleaning device 224 which is known per se and is therefore not illustrated in the drawing.

The annular disk 228 is provided with a sensor device 238 having a transponder 239 and a sensor element 240 which is formed as a conductor loop and is disposed on a flexible foil printed circuit together with the transponder 239 in accordance with the exemplary embodiments explained above. The sensor element 240 passes through a passage 241 in the annular disk 228 and projects, by way of its free end, beyond the lower face of the annular disk 228. The free end region of the sensor element 240 is disposed between the cleaning bristles 230. The transponder 239 is disposed on the upper face of the annular disk 228 which faces away from the cleaning bristles 230.

On its lower face, facing the transponder 239, the carrier plate 222 is provided with an antenna 243 of a read device 244 which is disposed on the upper face of the carrier plate 222. The read device 244 is connected to an evaluation electronics system of the cleaning device 224 in accordance with the exemplary embodiments explained above. A write/read memory of the transponder 239 can be read by means of the read device 244.

If the conductor loop of the sensor element 240 of the disk brush 220 is interrupted after corresponding wearing away of the cleaning bristles 230, as has already been explained above, this is identified by the read device 244 and the situation of the predefined degree of wear of the disk brush 220 being reached can then be optically or acoustically indicated on an indicator device of the cleaning device 224.

All the above embodiments share the common feature that the respective cleaning device has a cleaning tool with a sensor element, that a physical characteristic variable, for example an electrical characteristic variable, in particular an ohmic resistance, changes abruptly when a predefined degree of wear of the cleaning tool is reached, and this change in the characteristic variable can be sensed by an associated detector device. This provides the option for a display to indicate to the user that a maximum degree of wear has been reached, without the user having to inspect the cleaning tool himself. The risk of a floor surface being damaged or at least an inadequate cleaning result being achieved on account of a cleaning tool being excessively worn away is thus considerably reduced.

The invention claimed is:

1. Cleaning tool for a cleaning device, in particular for cleaning a surface, the cleaning tool being subject to wear during operation, said cleaning tool comprising:

a sensor device with a sensor element which has a physical characteristic variable which changes as a function of the degree of wear of the cleaning tool, wherein:

the sensor element is of flexible form, and the cleaning tool is rotatably mounted, cleaning elements of the cleaning tool being disposed ahead of and behind the sensor element in the direction of rotation of the cleaning tool.

2. Cleaning tool according to claim 1, wherein the physical characteristic variable of the sensor element is adapted to change abruptly when a predefined degree of wear of the cleaning tool is reached.

3. Cleaning tool according to claim 1, wherein the physical characteristic variable is at least one of a temperature, ohmic resistance, inductance or capacitance of the sensor element.

4. Cleaning tool according to claim 1, wherein the sensor element comprises an electrical conductor loop which is adapted to be interrupted when a predefined degree of wear of the cleaning tool is reached.

5. Cleaning tool according to claim 1, wherein the sensor device comprises a coil to which the sensor element is connected.

6. Cleaning tool according to claim 5, wherein the cleaning tool is rotatable about a rotation axis, and wherein the coil surrounds, in the circumferential direction, a cylindrical portion, which is aligned coaxially with the rotation axis, of a base body of the cleaning tool.

7. Cleaning tool according to claim 1, wherein the cleaning tool has a detector device which is associated with the sensor device and which is adapted to be connected to an indicator device and which detects the change in the physical characteristic variable of the sensor element.

8. Cleaning tool according to claim 7, wherein the cleaning tool comprises at least one of said indicator device and an energy source.

9. Cleaning tool according to claim 1, wherein the sensor device has electrical contact elements for connecting the sensor device to an external detector device which detects the change in the physical characteristic variable of the sensor element.

10. Cleaning tool according to claim 1, wherein the sensor device has electrical coupling elements for wireless coupling of the sensor device to an external detector device which detects the change in the physical characteristic variable of the sensor element.

11. Cleaning tool according to claim 1, wherein the sensor device has an electrical memory element.

12. Cleaning tool according to claim 1, wherein the sensor device has a transponder.

13. Cleaning tool according to claim 1, wherein the sensor element is disposed on a foil printed circuit.

14. Cleaning tool according to claim 13, wherein a transponder, which is electrically connected to the sensor element, is disposed on the foil printed circuit.

15. Cleaning tool according to claim 13, wherein the foil printed circuit is mounted on a carrier which can be axially inserted into a base body of the cleaning tool.

16. Cleaning tool according to claim 1, wherein the cleaning tool is formed as a rotatably mounted disk brush with a plate-like base body, from the lower face of which a large number of cleaning bristles project, the sensor element being disposed between the cleaning bristles.

17. Cleaning tool for a cleaning device, in particular for cleaning a surface, the cleaning tool being subject to wear during operation, said cleaning tool comprising:

a sensor device comprising a sensor element which has a physical characteristic variable which changes as a function of the degree of wear of the cleaning tool and a transponder, wherein the cleaning tool is rotatable about a rotation axis and has a base body with an annular region which is aligned coaxially with the rotation axis and on which the transponder is disposed.

18. Cleaning tool for a cleaning device, in particular for cleaning a surface, the cleaning tool being subject to wear during operation, said cleaning tool comprising:

a sensor device with a sensor element which has a physical characteristic variable which changes as a function of the degree of wear of the cleaning tool, wherein the cleaning tool is rotatable about a rotation axis and has a base body which is aligned coaxially with the rotation axis and from which the sensor element projects radially or axially in relation to the rotation axis.

19. Cleaning tool according to claim 18, wherein the sensor element is adapted to be latched or clamped to the base body.

20. Cleaning tool according to claim 18, wherein the sensor element is of flexible form.

21. Cleaning tool according to claim 20, wherein cleaning elements of the cleaning tool being disposed ahead of and behind the sensor element in the direction of rotation of the cleaning tool.

22. Cleaning tool for a cleaning device, in particular for cleaning a surface, the cleaning tool being subject to wear during operation, said cleaning tool comprising:

a sensor device with a sensor element which has a physical characteristic variable which changes as a function of the degree of wear of the cleaning tool, wherein the cleaning tool is formed as a rotatably mounted roller brush with a cylindrical base body from which a large number of cleaning bristles project outward, the sensor element being disposed between the cleaning bristles.

23. Cleaning device for cleaning a surface, in particular a floor surface, comprising:

at least one cleaning tool, said cleaning tool comprising:

a sensor device with a sensor element which has a physical characteristic variable which changes as a function of the degree of wear of the cleaning tool, wherein:

the sensor element is of flexible form, and the cleaning tool is rotatably mounted, cleaning elements of the cleaning tool being disposed ahead of and behind the sensor element in the direction of rotation of the cleaning tool, a detector device which is coupled to the sensor device for the purpose of sensing the change in the physical characteristic variable of the sensor element, and an indicator device which is connected to the detector device.

24. Cleaning device according to claim 23, wherein the detector device has an evaluation electronics system which is integrated in a control device of the cleaning device and is adapted to be connected to the sensor device via electrical lines.

25. Cleaning device according to claim 23, wherein the detector device has electrical coupling elements for wireless coupling of the detector device to the sensor device.

26. Cleaning device according to claim 25, wherein the detector device is coupled to the sensor device by way of a coil, the coil surrounding, in the circumferential direction, a cylindrical portion of a base body of the cleaning tool.

27. Cleaning device according to claim 25, wherein the detector device comprises a read device for reading a transponder of the cleaning tool.

28. Cleaning device according to claim 27, wherein the read device is disposed on or in a top wall which covers the cleaning tool.

29. Cleaning device according to claim 27, wherein the cleaning tool is rotatably mounted on a bearing, and wherein the read device is disposed on or in a ring which surrounds the bearing in the circumferential direction.

30. Cleaning device for cleaning a surface, in particular a floor surface, comprising:

at least one cleaning tool, said cleaning tool comprising a sensor device with a sensor element which has a physical characteristic variable which changes as a function of the degree of wear of the cleaning tool, a detector device which is coupled to the sensor device for the purpose of sensing the change in the physical characteristic variable of the sensor element, and an indicator device which is connected to the detector device, wherein:

the detector device has electrical coupling elements for wireless coupling of the detector device to the sensor device, the detector device comprises a read device for reading a transponder of the cleaning tool, and the read device is disposed on or in a ring which surrounds, in the circumferential direction, a cylindrical edge portion of a base body of the cleaning tool.

31. Cleaning device according to claim 30, wherein the ring is formed as a thread deflector.

* * * * *